US006223130B1

(12) United States Patent
Gray et al.

(10) Patent No.: US 6,223,130 B1
(45) Date of Patent: Apr. 24, 2001

(54) APPARATUS AND METHOD FOR DETECTION OF A LEAK IN A MEMBRANE OF A FLUID FLOW CONTROL SYSTEM

(75) Inventors: Larry Gray, Merrimack; Robert Bryant; Geoffrey Spencer, both of Manchester, all of NH (US)

(73) Assignee: DEKA Products Limited Partnership, Manchester, NH (US)

( * ) Notice: Subject to any disclaimer, the term of this patent is extended or adjusted under 35 U.S.C. 154(b) by 0 days.

(21) Appl. No.: 09/193,337

(22) Filed: Nov. 16, 1998

(51) Int. Cl.[7] ..... G01M 3/04

(52) U.S. Cl. ..... 702/51; 702/50; 702/47; 700/282; 73/40; 73/40.5 R

(58) Field of Search ..... 702/51, 31, 45, 702/50, 55, 100, 114, 138, 140, 176–178, 179, 182–185, 193, FOR 119, FOR 121, FOR 127, FOR 128, FOR 139, FOR 143, FOR 170, FOR 171; 700/281, 282, 301; 73/40, 40.5 R, 40.5 A, 40.58, 40.7, 861, 861.02, 861.03, 861.08, 85, 97, 98, 102, 645, 646, 653, 739, 741, 782, 650; 137/488, 513.3, 513.5, 513.7, 312, 386, 455, 458, 459, 487, 551, 552.7, 557–559, 563, 571, 593, 624.11–624.13, 624.18, 624.21, 624.27; 417/53, 63, 9, 102, 103; 377/20, 21; 340/605, 606, 611

(56) References Cited

U.S. PATENT DOCUMENTS 5,336,053 8/1994 Wynkoop ..... 417/53
5,384,714 * 1/1995 Kidd ..... 702/51
5,408,420 * 4/1995 Slocum et al. ..... 702/51
5,439,355 8/1995 Jimison et al. ..... 417/63
5,808,181 * 9/1998 Wamsiedler et al. ..... 210/646

FOREIGN PATENT DOCUMENTS 0 406 562 A2 9/1991 (EP) .
0 856 320 A1 5/1998 (EP) .

* cited by examiner

*Primary Examiner*—Hal Wachsman
(74) *Attorney, Agent, or Firm*—Bromberg & Sunstein LLP

(57) ABSTRACT

An apparatus, method, and computer program product for detection of fluid leakage through a membrane in a fluid flow control system. The fluid flow control system has a first chamber and a second chamber. A membrane is disposed between the first chamber and the second chamber. The second chamber has a connection to a pressure tank, the pressure tank has a fluid with a pressure, and the connection defines a fluid path. The method indudes in a first step, blocking the fluid path. The pressure of the fluid in the pressure tank is then adjusted. The pressure is measured in the pressure tank which creates a pressure measurement at each of a first set of multiple timed intervals while the fluid path is blocked and after the pressure is adjusted. A blocked pressure rate is calculated based on the pressure measurements in the pressure tank at the first set of multiple timed intervals. Next, the fluid path is unblocked. The pressure is measured within the pressure tank creating a pressure measurement at each of a second set of multiple timed intervals after the fluid path is unblocked. Then, an unblocked pressure rate is calculated based on the pressure measurements in the pressure tank at the second set of multiple timed intervals. Finally a leakage rate is calculated based on the blocked pressure rate and the unblocked pressure rate. An alarm is caused when the leakage rate becomes greater than a predetermined threshold value.

20 Claims, 4 Drawing Sheets

APPARATUS AND METHOD FOR DETECTION OF A LEAK IN A MEMBRANE OF A FLUID FLOW CONTROL SYSTEM

TECHNICAL FIELD

The present invention relates to fluid flow control systems and more specifically to the detection of fluid leakage in a fluid control system.

BACKGROUND

Numerous devices exist in the prior art for controlling the flow of fluid. A subclass of such devices includes fluid flow control systems. Fluid flow control systems regulate the rate of distribution of transport fluid through a line. Some examples of fluid control systems are kidney dialysis machines and intravenous blood transfusion devices. Fluid flow control system may include a cassette holder in which a disposable cassette is placed and wherein transport fluid is pumped by a membrane which is part of the cassette.

FIG. 1 shows a portion of a prior art flow control system 14 which includes a cassette 10 mounted on a cassette holder 12. A flexible membrane 11 covers the face of the flow control system cassette 10 and is permanently attached to the cassette 10.

The flow control system 14 has a valving chamber 17 located in the cassette and a valve control volume 19 located in the cassette holder 12 which defines a valve 50. A portion of the flexible membrane 11 separates the valving chamber 17 and the valve control volume 19 and acts as a barrier to keep control fluid in the valve control volume 19 from mixing and contaminating transport fluid in the valving chamber 17. The control fluid is delivered to the valve control chamber 19 through a valve control fluid line 15.

The flow control system 14 has a pump chamber 18 located in the flow control system cassette 10 and a pump control volume 100 located in the cassette housing 12 which defines a pump 52. A portion of the flexible membrane 11 separates the pump chamber 18 and the pump control volume 100 and acts as a barrier to keep the control fluid in the pump control chamber 100 from mixing and contaminating the transport fluid in the pump chamber 18 while transport fluid is being pumped into or out of the pump chamber 18. The control fluid is delivered to the pump control chamber 100 through a pump control fluid line 16.

One problem with such a system is the cassette membrane may become punctured during transportation and handling of the cassette. If pinholes develop in the cassette membrane, the transport fluid may leak into the cassette holder requiring the cassette holder to be cleaned and replaced. Additionally, the control fluid may contaminate the transport fluid. The prior art system described above did not determine if there is a leak in the cassette after it is mounted in the cassette holder and prior to any transport fluid being pumped through the cassette.

SUMMARY OF THE INVENTION

In accordance with one embodiment of the invention, a method for detecting a leakage rate of fluid through a membrane in a fluid flow control system is provided. The fluid flow control system has a first chamber and a second chamber, the membrane is disposed between the first chamber and the second chamber, the second chamber has a connection to a pressure tank, the pressure tank has a fluid with a pressure, and the connection defines a fluid path. The method includes in a first step, blocking the fluid path. The pressure of the fluid in the pressure tank is then adjusted. The pressure is measured in the pressure tank which creates a pressure measurement at each of a first set of multiple timed intervals while the fluid path is blocked and after the pressure is adjusted. A blocked pressure rate is calculated based on the pressure measurements in the pressure tank at the first set of multiple timed intervals.

Next, the fluid path is unblocked. The pressure is measured within the pressure tank creating a pressure measurement at each of a second set of multiple timed intervals after the fluid path is unblocked. Then, an unblocked pressure rate is calculated based on the pressure measurements in the pressure tank at the second set of multiple timed intervals. Finally a leakage rate is calculated based on the blocked pressure rate and the unblocked pressure rate.

In another embodiment of the method a further step is added. An alarm is caused when the leakage rate becomes greater than a predetermined threshold value. The alarm may originate in the processor. The alarm may also be either a visual alarm or an auditory alarm.

In a further related embodiment, in the step of measuring a pressure at a first set of multiple timed intervals and in the step of measuring a pressure at a second set of multiple timed intervals the pressure is measured with a transducer. In yet another related embodiment, in the step of calculating a blocked pressure rate and in the step of calculating an unblocked pressure rate, the rates are calculated in a processor.

In yet another related embodiment, additional steps are added. After the step of measuring the pressure at a first set of multiple timed intervals, each of the pressure measurements is stored in a memory unit and the pressure measurements are then provided to the processor. Additionally, after the step of measuring the pressure at a second set of multiple timed intervals, each of the pressure measurements may be stored in the memory unit and then provided to the processor.

In another embodiment of the invention, the embodiment is directed toward a flow control system. The system may include a first chamber and a second chamber with a membrane disposed between the first and second chambers. The system further includes a pressure tank containing a fluid having a pressure connected to the second chamber. A transducer is disposed within the pressure tank which creates a pressure signal. A valve is disposed between the chamber and the pressure tank. The system also includes a valve controller connected to the valve, a pump connected to the pressure tank and a processor connected to the transducer, to the pump and to the valve controller.

The processor performs the following. The processor signals the valve controller to shut the valve. The processor adjusts the pressure of the fluid in the pressure tank with the pump. The pressure signal is read from the transducer at a first set of predetermined timed intervals and a baseline leak rate is calculated based on the first set of pressure signals while the valve is shut by the processor. The processor then sends a signal to the valve controller to open the valve. The processor reads the pressure signal from the transducer at a second set of predetermined timed intervals while the valve is open and calculates a membrane leak rate based on the second set of pressure signals. A leakage rate is calculated based on the baseline leak rate and the membrane leak rate and an alarm signal is created if the leakage rate exceeds a predefined value. The alarm signal may be an auditory or a visual alarm. In a preferred embodiment the fluid may be air.

The system may further include a memory unit for storing the pressure signals at the first set of predetermined timed intervals and storing the pressure signals at the second set of predetermined timed intervals.

A computer program product is provided, in yet another embodiment of the invention. The computer program product is a computer usable medium having computer readable program code thereon. The computer readable program code includes:

program code for activating a valve controller for blocking the fluid path.

program code for adjusting the pressure of the fluid in the pressure tank;

program code for reading the pressure in the pressure tank;

program code for creating a pressure measurement at each of a first set of multiple timed intervals while the fluid path is blocked and after the pressure is adjusted;

program code for calculating a blocked pressure rate based on the pressure measurements in the pressure tank at the first set of multiple timed intervals;

program code for activating the valve controller unblocking the fluid path;

program code for reading the pressure within the pressure tank;

program code for creating a pressure measurement at each of a second set of multiple timed intervals after the fluid path is unblocked;

program code for calculating an unblocked pressure rate based on the pressure measurements in the pressure tank at the second set of multiple timed intervals; and program code for calculating a leakage rate based on the blocked pressure rate and the unblocked pressure rate.

The computer program product may further include program code for causing an alarm when the leakage rate becomes greater than a predetermined threshold value.

BRIEF DESCRIPTION OF THE DRAWINGS

The invention will be more readily understood by reference to description, taken with the accompanying drawings, in which.

DETAILED DESCRIPTION OF THE SPECIFIC EMBODIMENTS

Figure 1:
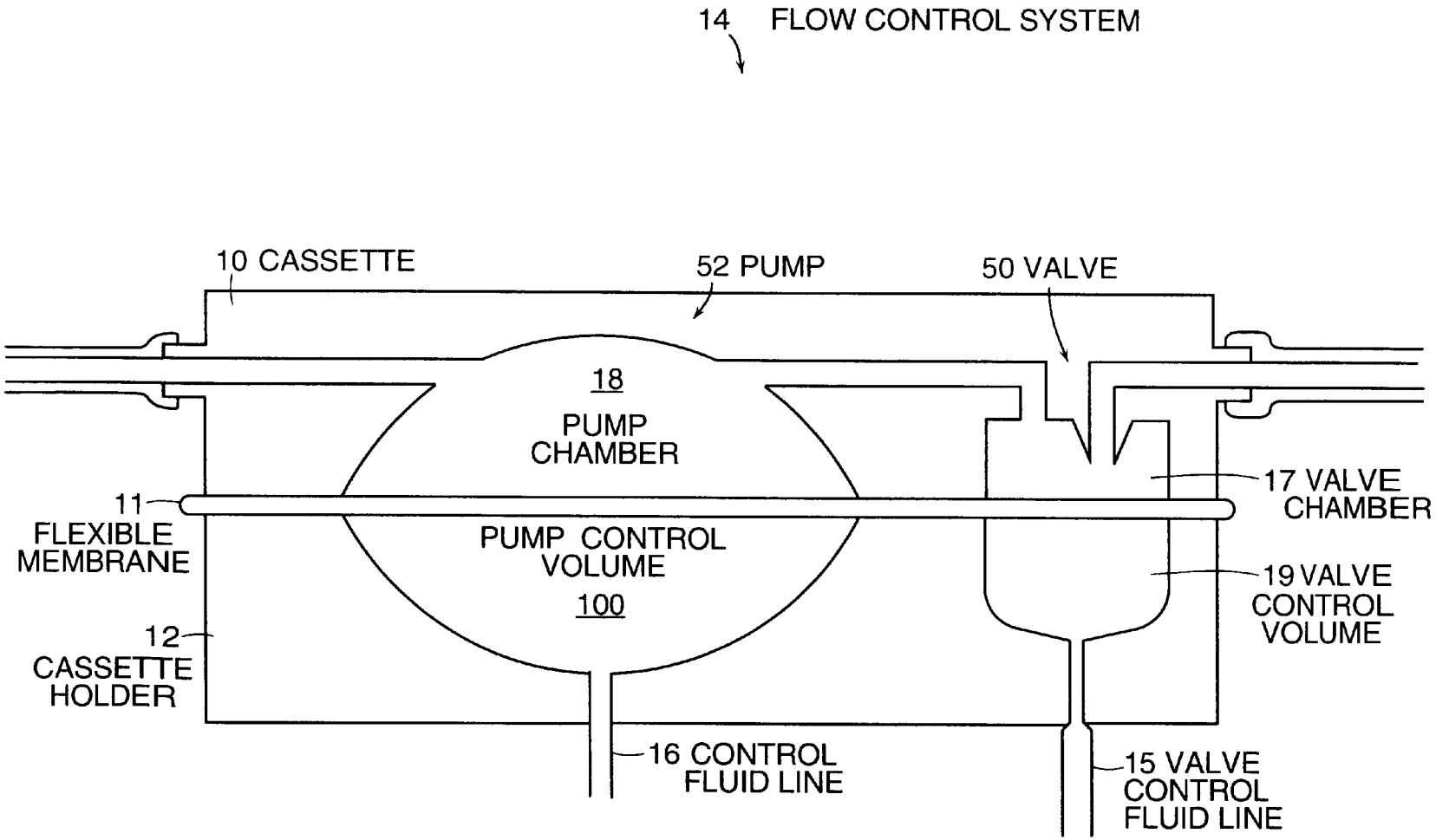
FIG. 1 PRIOR ART
FIG. 1 is a schematic of a prior art flow control system.
Figure 2:
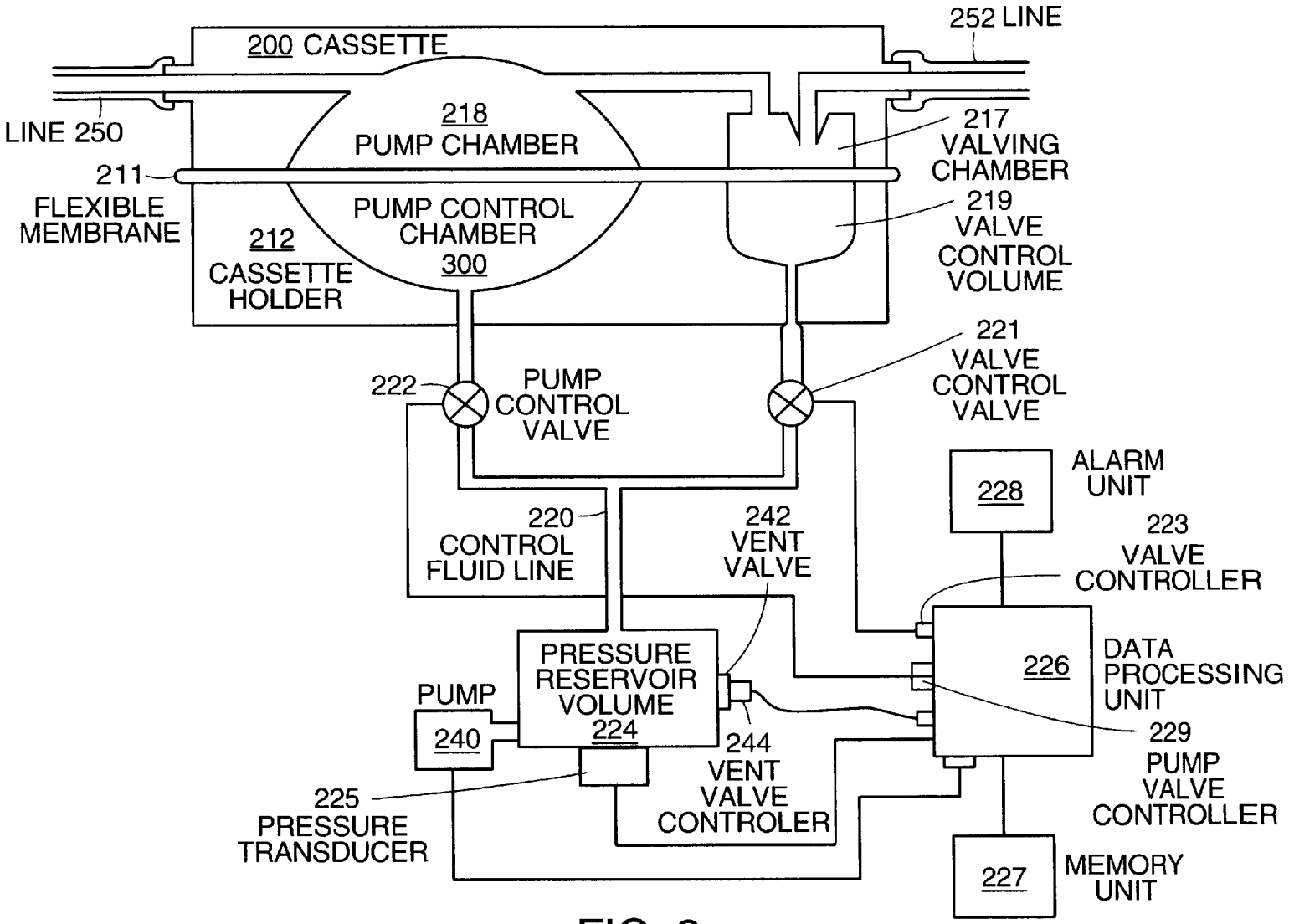
FIG. 2 is a schematic of one embodiment of the invention for detecting holes in a fluid control system cassette.

An embodiment of the apparatus for the detection of a leak in a membrane of a fluid flow control system cassette is shown in FIG. 2. The detection apparatus may be used in a fluid flow control system similar to the fluid flow control systems described in U.S. Pat. No. 4,778,451 to Kamen and in related patents U.S. Pat. Nos. 4,976,162, 5,088,515, and 5,178,182 all to Kamen, which are incorporated by reference herein in their entirety.

In an embodiment of the apparatus, the fluid flow control system includes a cassette holder 212 in which a cassette 200 is placed. The cassette holder 212 may be a housing in which the cassette is enclosed or it may be a shelf on which the cassette is mounted. In one embodiment of the apparatus where the fluid control system is used for kidney dialysis, multiple patients may use the same cassette holder where each patient has their own disposable cassette.

A transport fluid may be pumped through the cassette 200 once the cassette 200 is connected to the cassette holder 212. In this embodiment of the apparatus, the cassette 200 includes at least two chambers: a pump chamber 218 and a valving chamber 217, however it is possible that the apparatus has a single chamber or multiple chambers. In a preferred embodiment, the cassette has a flexible exterior membrane 211 which will deform in response to pressure from a control fluid. This deformation of the membrane causes the transport fluid to be pumped.

When the cassette 200 is properly positioned with respect to the cassette holder 212 the cassette membrane 211 is exposed to two chambers defined by the cassette holder 212: a valve control chamber 219 and a pump control chamber 300. In other embodiments of the apparatus, the cassette holder 212 may have a single chamber or multiple chambers. The valve control chamber 219 and the pump control chamber 300 of the cassette holder 212 align with the pump chamber 218 and the valving chamber 217 of the cassette, respectively. Pressure in the valve control chamber 219 and the pump control chamber 300 is regulated by a valve control valve 221 and by a pump control valve 222. The valve control valve 221 is controlled by a valve controller 223 and the pump control valve 222 is controlled by a pump valve controller 229. A control fluid line 220 supplies a control fluid from a pressure reservoir volume 224. The pressure reservoir volume may also be referred to as a pressure tank. The pressure of the control fluid within the pressure tank may be increased through pump 240 or relieved by opening a vent valve 242. Additional valves, pumps, chambers and pressure reservoir tanks may be incorporated into the apparatus without changing the overall function of the fluid control system.

By alternating the opening and closing of the pump control valve 222 and the valve control valve 221, the control fluid can be dispersed from the pressure reservoir volume 224 to change the pressure placed on the membrane 211 at the pump control chamber 300 and at the valve control chamber 219. Through alternating pressure change, the transport fluid is directed through the cassette 200.

The system may precisely and accurately measure the volume of fluid being transported using known methods, such as Boyle's law, as disclosed in U.S. Pat. No. 4,808,161 or acoustic spectral analysis as disclosed in U.S. Pat. No. 5,349,852 herein incorporated by reference in their entirety. The pressure in the pressure reservoir volume 224, is measured by a pressure transducer 225. (Any instrument for converting a fluid pressure to an electrical, hydraulic, optical or digital signal will be referred to as a "transducer".) The output signal from the pressure transducer 225 is relayed to a data processing unit 226, such as, a microprocessor.

The data processing unit 226 has a memory unit 227 capable of storing and retrieving data from the data processing unit 226. The data processing unit 226 has the ability to control the operation of the valve control valve 221 by a valve controller 223 and the pump control valve 222 by the pump valve controller 229 and the vent valve 242 by the vent valve controller 244. The data processing unit 226 also controls an alarm unit 228. The alarm unit 228 may be, but is not limited to, an auditory alarm or a visual alarm. The alarm unit 228 may also contain shutdown mechanisms that, when activated, prevents the use of a damaged flow control system cassette 220.

Figure 3:
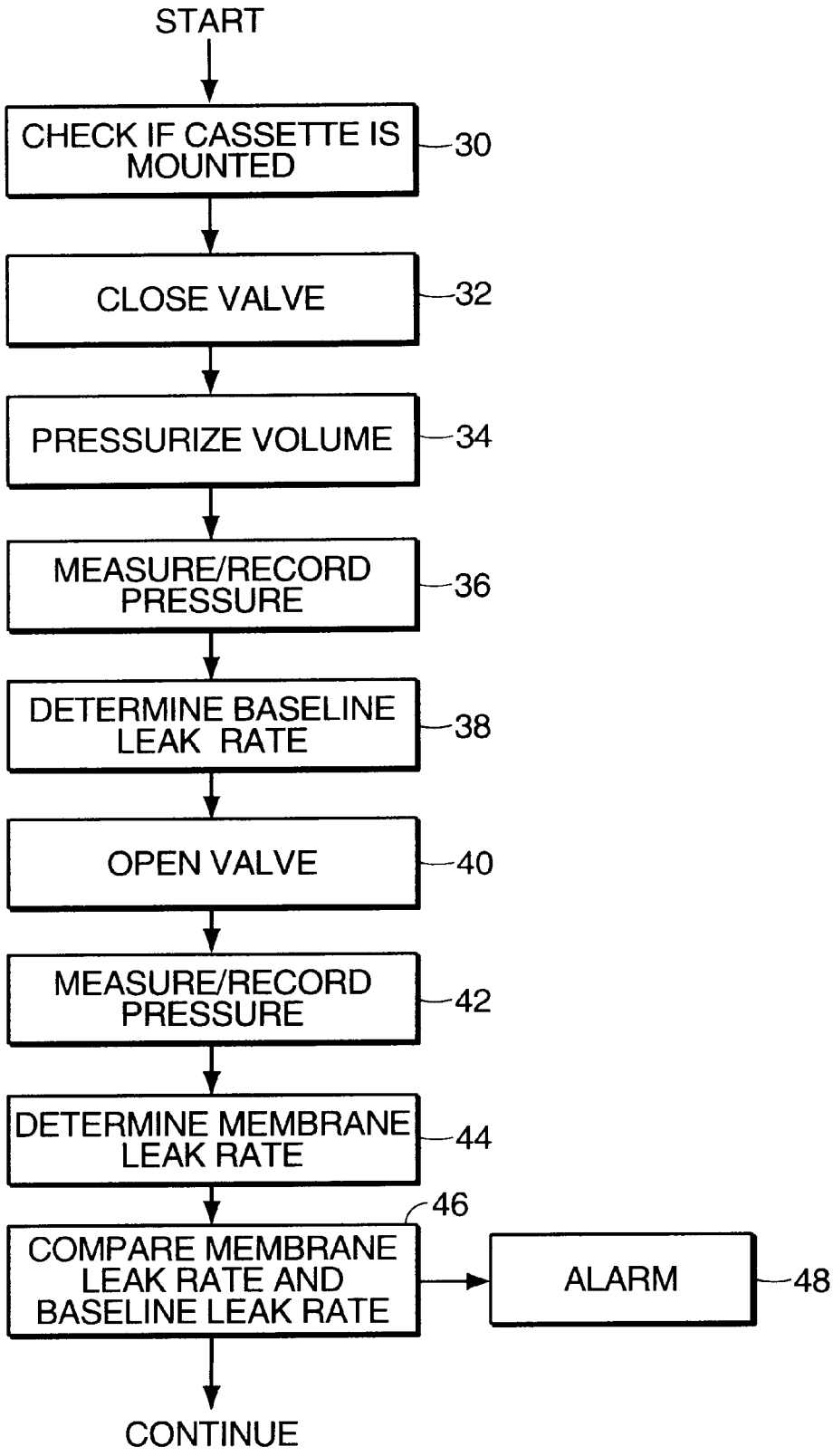
FIG. 3 is a block diagram illustrating a method of using one embodiment of the invention.
Figure 4:
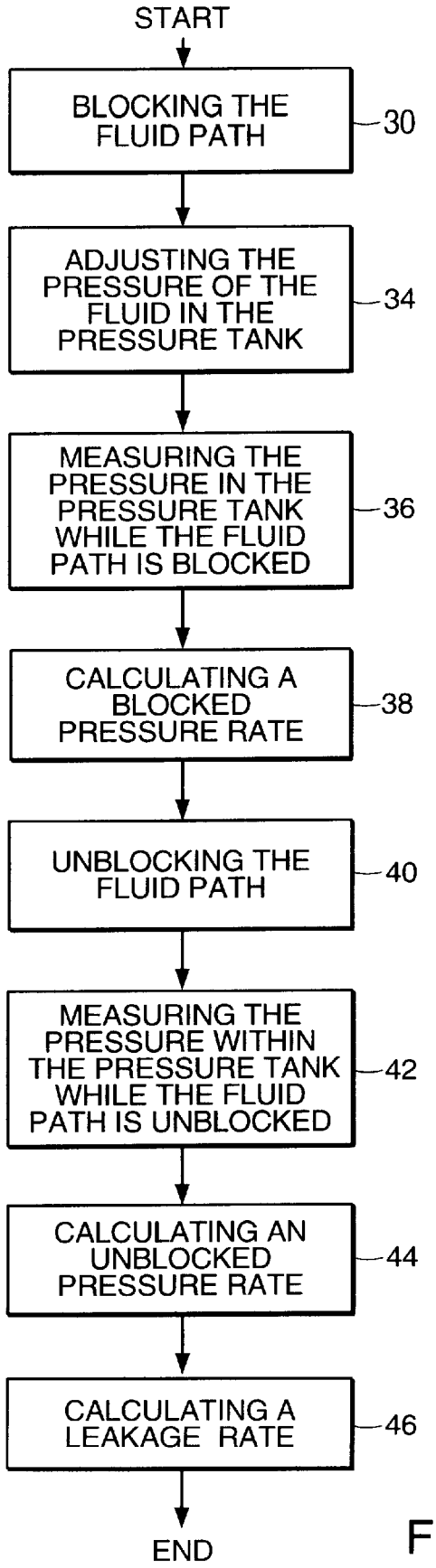
FIG. 4 is a block diagram illustrating a subset of the method of FIG. 3.
Figure 4:
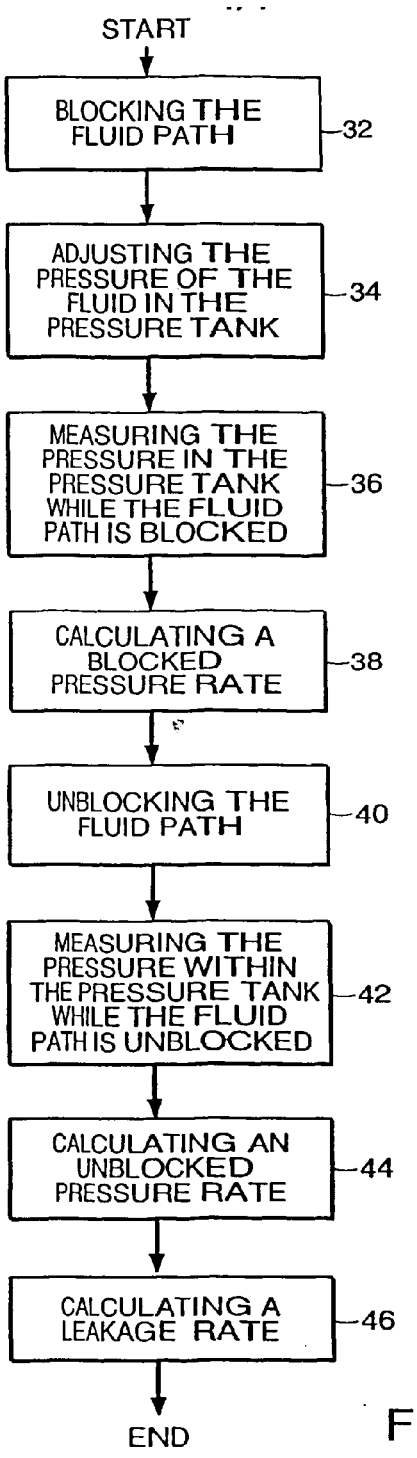

FIG. 3 is a block diagram showing a method of using one embodiment of the invention. FIG. 4 is a block diagram illustrating a subset on the method of FIG. 3. The steps of the following described method are performed on the flow control system prior to transport fluid being pumped through lines 250 and 252. The cassette is in a "dry" state, such that no transport fluid has entered the cassette and the control fluid is not pressurized by the pump 240.

During the first step (Step 30), the data processing unit 226 will verify that a flow control system cassette 200 is mounted on the cassette holder 212. The flow control system has either a contact switch, or a sensor which sends a signal to the data processing unit 226 indicating that the cassette 200 is in the proper position for operation of the control flow system and pumping of the transport fluid.

If a flow control system cassette 200 is properly mounted on the cassette holder 212, the data processing unit 226 proceeds to close valves 221, 222 and 242 (Step 32) wherein the data processing unit 226 sends a signal to the valve controller 223 to close the valve control valve 221 and sends a signal to the pump valve controller 229 to dose the pump control valve 222 thereby isolating the pressure reservoir volume 224 from the valve control chamber 219 and the pump control chamber 300. By isolating the cassette holder from the cassette, a baseline leak rate may be calculated for the cassette holder.

In the pressurize volume step (Step 34), the pressure reservoir volume 224 is pressurized with a control fluid. The data processing unit sends a signal to the pump 240 to pressurize the control fluid. In a preferred embodiment, the control fluid is air. The pressure of the control fluid of the pressure reservoir volume 224 may also be decreased by creating a partial vacuum with pump 240 on the control fluid. In other embodiments, a second pressure reservoir tank and a control fluid valve may be incorporated into the system to provide a partial vacuum reservoir for the system. The control fluid valve may be placed at a position along the control fluid line 220 with the second tank attached to the control fluid valve. The pressure of the control fluid within the second tank may be decreased to below atmospheric by the vacuum pump. The control fluid valve may then be opened, decreasing the overall pressure of the control fluid. As in other embodiments, the data processing unit 226 controls operation of the vacuum pump and the control fluid valve.

In the step of recording and measuring (step 36), the signal from the pressure transducer 225 is sent to the data processing unit 226, then converted into data by an analog to digital conversion. In other embodiments, the transducer 225 may produce a digital signal where the data processing unit 226 would not perform an analog to digital conversion. A plurality of measurements at predetermined times are saved over a sampling period and finally stored in the memory unit 227 in digital form. In one embodiment, a first pressure measurement is made and stored at the beginning of the sampling period and at the end of the sampling period, a second pressure measurement is made. The selection of the sampling period length is determined, in part, by such factors as the size of the pressure reservoir and the resolution of the pressure transducer. The larger the pressure reservoir and the higher the resolution of the transducer the shorter the sampling period needs to be.

In the step of determining a baseline leak rate of the system($L_B$) (step 38), the data processing unit 226 first retrieves the measurement data from the memory unit 227 and calculates a baseline leak rate by first taking the difference between the pressure measurement at the beginning of the sampling period and the measurement at the end of the sampling period and dividing by the sampling period. Other methods for determing a rate may also be implemented, where more than two measurement values are used, such as, determining a least-squares-fit line prior to calculating the baseline leakrate. In the step of opening the valve (step 40), the data processing unit 226 sends a signal to the valve controller 223 and the pump valve controller 229 to open the valve control valve 221 and the pump control valve 222, respectively.

In the next step (step 42), the pressure transducer 225 produces a pressure signal in the pressure reservoir volume 224 and sends the signal back to the data processing unit 226 where the signal is converted from analog to digital. The digital data is sampled at least twice during the sampling period and the data is then stored in the memory unit 227. In one embodiment, a first pressure measurement is made and stored at the beginning of the sampling period and at the end of the sampling period, a second pressure measurement is made.

The data processing unit 226 then calculates the leak rate of the membrane ($L_M$) (Step 44) by first taking the difference between the pressure measurement at the beginning of the sampling period and the measurement at the end of the sampling period and then dividing by the sampling period. All of the data measurements that are used for calculating LM are obtained while the valve control valve 221 and the pump control valve 222 are open. In other embodiments, alternative techniques for calculating the membrane leakrate may be used when there are more than two pressure measurements. Such techniques are known to those skilled in the art and include calculating a least-squares-fit line prior to calculating the membrane leakrate.

In comparing $L_B$ and $L_M$ (step 46), the data processing unit 226 compares the two leak rates and determines if the difference between the leak rates is greater than a critical leak rate. The critical leak rate is an empirically determined value found by measuring the leak rate of the cassette with known defects in the membrane.

If the data processing unit 226 determines that the difference between the two leak rates is greater than the critical leak rate, the data processing unit 226 will initiate an alarm sequence (Step 48). The alarm sequence may include activating an auditory or visual indicator and may also include a shutdown procedure to prevent the use of a faulty flow control system cassette 200. Comparing the baseline leak rate for the system and the leak rate of the membrane, allows the data processing unit to determine if the membrane has been punctured or is defective before it is used for pumping the transport fluid. This provides a higher level of safety by eliminating the possibility of contaminating the transport fluid through exposure to the control fluid. Additionally, this system aids in the accuracy of the volumetric measurement of transport fluid that is delivered by stopping the fluid flow control system from operating when a puncture occurs which would bleed off transport fluid from its intended destination and produce erroneous results. Additionally the system prevents transport fluid from flowing into the cassette holder. If transport fluid flows into the cassette holder, the cassette holder must be cleaned.

Although the invention has been described with reference to several preferred embodiments, it will be understood by one of ordinary skill in the art that various modifications can be made without departing from the spirit and the scope of the invention, as set forth in the claims below.

What is claimed is:

1. A method for detecting a leakage rate of fluid through a membrane in a fluid flow control system having a first chamber and a second chamber, the membrane being disposed between the first chamber and the second chamber, the second chamber having a connection to a pressure tank, the pressure tank having a fluid with a pressure, the connection defining a fluid path, the method comprising:

blocking the fluid path;

adjusting the pressure of the fluid in the pressure tank;

measuring the pressure in the pressure tank creating a pressure measurement at each of a first set of multiple timed intervals while the fluid path is blocked and after the pressure in the pressure tank is adjusted;

calculating a blocked pressure rate based on the pressure measurements in the pressure tank at the first set of multiple timed intervals;

unblocking the fluid path;

measuring the pressure within the pressure tank creating a pressure measurement at each of a second set of multiple timed intervals after the fluid path is unblocked;

calculating an unblocked pressure rate based on the pressure measurements in the pressure tank at the second set of multiple timed intervals; and calculating a leakage rate based on the blocked pressure rate and the unblocked pressure rate.

2. The method according to daim 1, further comprising the step of causing an alarm when the leakage rate becomes greater than a predetermined threshold value.

3. The method according to claim 2, wherein the step of causing an alarm occurs in a processor.

4. The method according to claim 2 wherein the alarm is an auditory alarm.

5. The method according to claim 2 wherein the alarm is a visual alarm.

6. The method according to claim 1, wherein in the step of measuring a pressure at a first set of multiple timed intervals and in the step of measuring a pressure at a second set of multiple timed intervals the pressure is measured with a transducer.

7. The method according to claim 1, wherein in the step of calculating a blocked pressure rate and in the step of calculating an unblocked pressure rate the rates are calculated in a processor.

8. The method according to claim 1, wherein the fluid is air.

9. The method according to claim 1, further comprising after the step of measuring the pressure at a first set of multiple timed intervals:

storing each of the pressure measurements in a memory unit; and providing the pressure measurements in the memory unit to a processor.

10. The method according to claim 1, further comprising after the step of measuring the pressure at a second set of multiple timed intervals;

storing each of the pressure measurements in a memory unit; and providing the pressure measurements in the memory unit to a processor.

11. A fluid flow control system comprising:

a first chamber;

a second chamber;

a pressure tank containing a fluid having a pressure connected to the second chamber;

a transducer disposed within the pressure tank for creating a pressure signal;

a valve disposed between the second chamber and the pressure tank;

a membrane disposed between the first chamber and the second chamber;

a valve controller connected to the valve;

a pump connected to the pressure tank; and a processor connected to the transducer, to the pump and to the valve controller for:

a) signaling the valve controller to shut the valve;

b) adjusting the pressure of the fluid in the pressure tank with the pump;

c) reading the pressure signal from the transducer at a first set of predetermined intervals while the valve is shut creating a first set of pressure signal readings;

d) calculating a baseline leak rate based on the first set of pressure signals while the valve is shut;

e) sending a signal to the valve controller to open the valve;

f) reading the pressure signal from the transducer at a second set of predetermined timed intervals creating a second set of pressure signal readings while the valve is open;

g) calculating a membrane leak rate based on the second set of pressure signals;

h) calculating a leakage rate based on the baseline leak rate and the membrane leak rate; and i) creating an alarm signal if the leakage rate exceeds a predefined value.

12. The system according to claim 11, wherein the alarm signal causes an auditory alarm.

13. The system according to claim 11, wherein the alarm signal causes a visual alarm.

14. The system according to claim 11, wherein the fluid is air.

15. The system according to claim 11, further comprising a memory unit for storing the pressure signals at the first set of predetermined timed intervals and storing the pressure signals at the second set of predetermined timed intervals.

16. The system according to claim 11, wherein the first chamber is disposed within a cassette wherein the membrane forms an exterior surface of the cassette.

17. A computer program product for use on a computer system for detecting a leakage rate of fluid through a membrane in a fluid flow control system having a first chamber and a second chamber, the membrane disposed between the first chamber and the second chamber, the second chamber having a connection to a pressure tank, the pressure tank having a fluid with a pressure, the connection defining a fluid path, the computer program product comprising a computer usable medium having computer readable program code thereon, the computer readable program code including:

program code for activating a valve controller for blocking the fluid path;

program code for adjusting the pressure of the fluid in the pressure tank;

program code for reading the pressure in the pressure tank while the fluid path is blocked;

program code for creating a pressure measurement at each of a first set of multiple timed intervals while the fluid path is blocked and after the pressure is adjusted;

program code for calculating a blocked pressure rate based on the pressure measurements in the pressure tank at the first set of multiple timed intervals;

program code for activating the valve controller unblocking the fluid path;

program code for reading the pressure within the pressure tank while the fluid path is unblocked;

program code for creating a pressure measurement at each of a second set of multiple timed intervals after the fluid path is unblocked;

program code for calculating an unblocked pressure rate based on the pressure measurements in the pressure tank at the second set of multiple timed intervals; and program code for calculating a leakage rate based on the blocked pressure rate and the unblocked pressure rate.

18. The computer program product according to claim 17, further comprising program code for causing an alarm when the leakage rate becomes greater than a predetermined threshold value.

19. The computer program product according to claim 17 further comprising:

program code for causing a alarm to be an auditory alarm.

20. The computer program product according to claim 17 further comprising program code for causing a alarm to be a visual alarm.

* * * * *

UNITED STATES PATENT AND TRADEMARK OFFICE

CERTIFICATE OF CORRECTION

PATENT NO. : 6,223,130 B1
DATED : April 24, 2001
INVENTOR(S) : Larry Gray et al.

It is certified that error appears in the above-identified patent and that said Letters Patent is hereby corrected as shown below:

Drawings,
Please delete Fig. 4 (sheet 4 of 4) and insert the attached Fig. 4.

Column 3,
Line 45, delete the word "and"
Line 47, replace "." with -- ; and --.

Column 5,
Line 1, replace "subset on the method" with -- subset of the method --.

Column 8,
Line 18, replace "signals while the valve is shut" with -- signal reading --.
Line 26, replace "signals" with --signal readings --.

Column 10,
Lines 7 and 9, replace "a alarm" with -- an alarm --.

Signed and Sealed this

Twenty-fourth Day of August, 2004

JON W. DUDAS
*Director of the United States Patent and Trademark Office*